US005171204A

United States Patent [19]

Müller

[11] Patent Number: 5,171,204

[45] Date of Patent: Dec. 15, 1992

[54] PRINTING PRESS WITH APPARATUS FOR FOLDING PRINTED PAPER

[75] Inventor: Hans Müller, Leimen, Fed. Rep. of Germany

[73] Assignee: Heidelberger Druckmaschinen Aktiengesellschaft, Heidelberg, Fed. Rep. of Germany

[21] Appl. No.: 768,376

[22] Filed: Sep. 27, 1991

[30] Foreign Application Priority Data

Oct. 4, 1990 [DE] Fed. Rep. of Germany ..... 4031298

[51] Int. Cl.[5] ..... B41F 13/58; B65H 45/18

[52] U.S. Cl. ..... 493/444; 493/445; 74/37; 74/52

[58] Field of Search ..... 493/427, 444, 445, 468, 493/476; 74/37, 52

[56] References Cited

U.S. PATENT DOCUMENTS 3,401,568 9/1968 Blatt ..... 74/52

4,509,939 4/1985 Müller ..... 493/444

4,568,319 2/1986 Samata ..... 493/444

FOREIGN PATENT DOCUMENTS 3046051 12/1983 Fed. Rep. of Germany .

*Primary Examiner*—William E. Terrell

*Attorney, Agent, or Firm*—Nils H. Ljungman and Associates

[57] ABSTRACT

A web-fed printing press with apparatus for the making of a longitudinal fold in the conveying direction of the printed copies, the longitudinal fold being preferably produced after a cylinder cross-fold. The folding device includes a folding blade disposed parallel to the conveying direction, the folding blade being moved in a reciprocal vertical fashion through the intermediary of drive cranks. Without sliding guide parts, the vertical reciprocating motion is executed towards the printed copy, and the additional crank is driven through the intermediary of a toothed belt.

20 Claims, 3 Drawing Sheets

PRINTING PRESS WITH APPARATUS FOR FOLDING PRINTED PAPER

BACKGROUND OF THE INVENTION

1. Field of the Invention

The present invention relates to a folding device for web-fed rotary printing presses, that is, for the making of a longitudinal fold in the conveyed direction of the printed copies, the longitudinal fold being preferably produced after a cylinder cross-fold, the folding device including a folding blade disposed parallel to the conveying direction, the folding blade being suspended on two drive cranks, rotating at identical speed, and with the folding blade being moved up and down by drive cranks and, when in its bottom position, pushing the printed copies between two driven folding rollers.

2. Background of the Invention

In a known device (for example, in the device disclosed in German Patent No. 30 46 051), the folding blade is moved vertically in each direction during the folding operation through the intermediary of a planetary-gear system. In such a known device, the gear system requires lubrication (e.g., with oil), with the result that the possibility of lubricant getting onto the folded copies cannot be eliminated.

OBJECT OF THE INVENTION

One object of the present invention is the provision of a folding device, rotating at high speed, for the making of a longitudinal fold without sliding guide parts and with a reversal of motion, in which folding device (i.e., the folding blade), during the folding operation, executes a reciprocating motion, vertical in each direction, towards the printed copy, and in which the drive parts can be operated without the need of a lubricant.

SUMMARY OF THE INVENTION

This and other objects of the invention are achieved through the construction described herein. The design disclosed has the advantage that the drive of the folding blade cannot cause any soiling of the folded copies. Various advantageous embodiments of the invention are disclosed which may be implemented without any major technical outlay.

One aspect of the invention resides broadly in a rotary printing press having an apparatus for folding a sheet of paper, the sheet of paper being conveyed in a direction of travel within the rotary printing press, the printing press including a web moving in the direction of travel for conveying the sheet of paper, the apparatus comprising: a folding blade; and transmission apparatus for moving the folding blade in a periodic reciprocating motion at a right angle to the direction of travel; the transmission apparatus comprising: a pair of drive wheels spaced from one another along the direction of travel, each of the pair of drive wheels having a pivotally mounted first axle attached thereto, an apparatus for rotationally powering one of the pair of drive wheels, a flexible belt engaging at least a portion of the peripheral surfaces of both of the pair of drive wheels for transmitting rotational power therebetween, a first pair of crank members, each of the first pair of crank members being attached to one of the first axle members, each of the first pair of crank members extending radially outward from the rotational axis of the attached first axle member, and each of the first pair of crank members being provided with a rotational bearing, the distance between the center of said rotational bearing provided on each of the first pair of crank members and the rotational axis of the attached first axle being $r_1$ and a second pair of axles, each of the second pair of axles being rotationally mounted in one of the rotational bearings, a first gear surface encircling each of the pair of first axles, a second gear surface provided on each of the second pair of axles and positioned adjacent one of the first gear surfaces, a pair of flexible belts rotationally interconnecting each of the first gear surfaces with each of the respective adjacent second gear surfaces, a second pair of crank members, each of the second pair of crank members being attached to one of the second pair of axles, each of the second pair of crank members extending radially outward from the rotational axis of the attached second axle and radially inward towards the rotational axis of an associated first axle, and each of the second pair of crank members being pivotally attached to a portion of the folding blade, the distance between the point of pivotal attachment of the folding blade to each of the second pair of crank members and the rotational axis of the attached second axle being $r_2$.

Another aspect resides in an apparatus for folding a sheet of paper, the sheet of paper being conveyed in a direction of travel within a rotary printing press, the printing press including a web moving in the direction of travel for conveying the sheet of paper , the apparatus comprising: a folding blade; and a transmission apparatus for moving the folding blade in a periodic reciprocating motion at a right angle to the direction of travel; the transmission apparatus comprising: a pair of drive wheels spaced from one another along the direction of travel, each of the pair of drive wheels having a pivotally mounted first axle attached thereto; an apparatus for rotationally powering one of the pair of drive wheels; a flexible belt engaging at least a portion of the peripheral surfaces of both of the pair of drive wheels for transmitting rotational power therebetween; a first pair of crank members, each of the first pair of crank members being attached to one of the first axle members, each of the first pair of crank members extending radially outward from the rotational axis of the attached first axle member, and each of said first pair of crank members being provided with a rotational bearing, the distance between the center of the rotational bearing provided on each of the first pair of crank members and the rotational axis of the attached first axle being $r_1$; a second pair of axles, each of the second pair of axles being rotationally mounted in one of the rotational bearings; a first gear surface encircling each of the pair of first axles; a second gear surface provided on each of the second pair of axles and positioned adjacent one of the first gear surfaces; a pair of flexible belts rotationally interconnecting each of the first gear surfaces with each of the respective adjacent second gear surfaces; a second pair of crank members, each of the second pair of crank members being attached to one of the second pair of axles, each of the second pair of crank members extending radially outward from the rotational axis of the attached second axle and radially inward towards the rotational axis of an associated first axle, and each of the second pair of crank members being pivotally attached to a portion of the folding blade, the distance between the point of pivotal attachment of the folding blade to each of the second pair of crank members and the rotational axis of the attached second axle being $r_2$.

BRIEF DESCRIPTION OF THE DRAWINGS

A preferred embodiment of the invention is illustrated in the drawings, wherein.

DESCRIPTION OF THE PREFERRED EMBODIMENT

Figure 1:
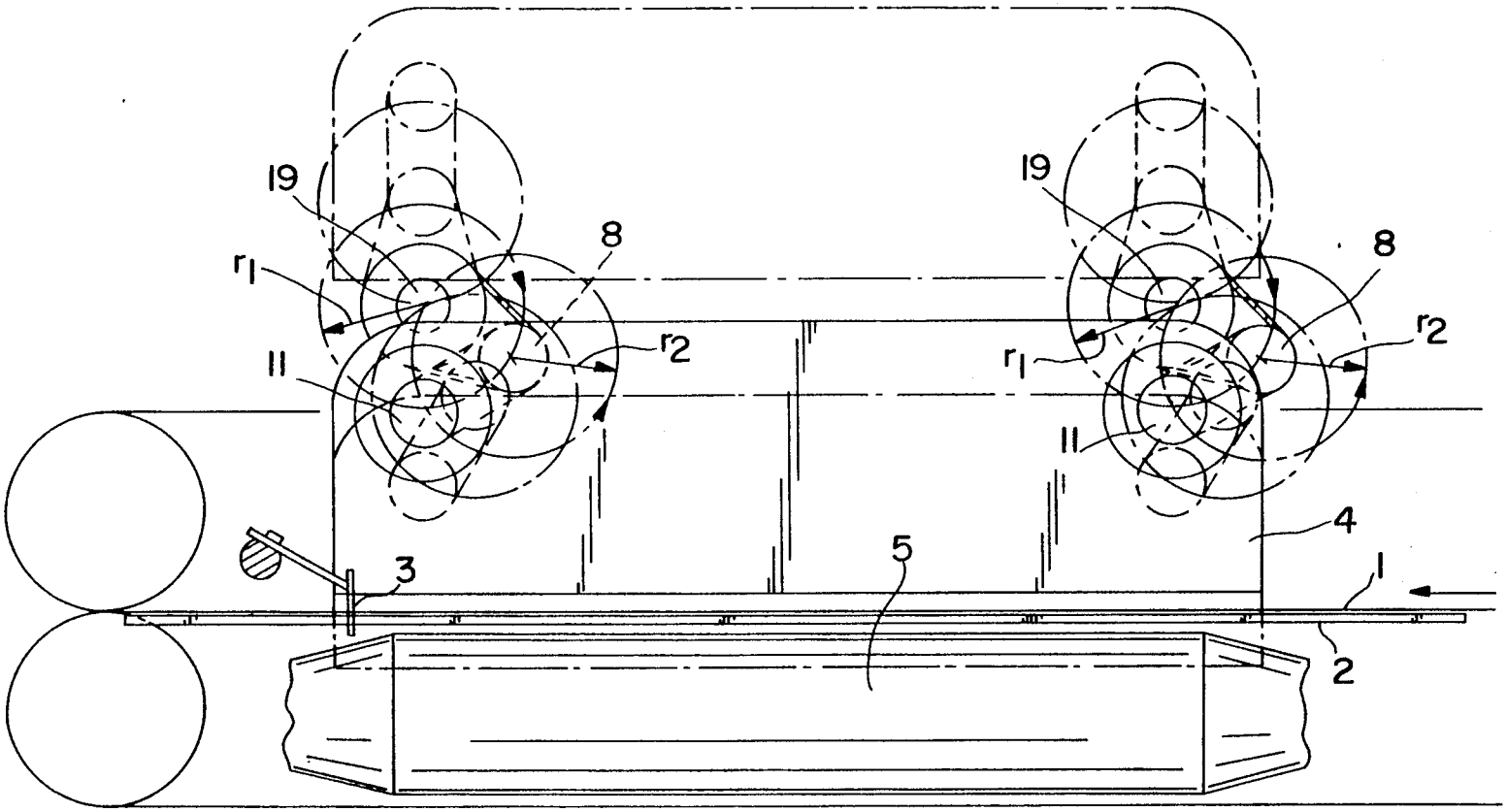
FIG. 1 is a front elevational view of a folding apparatus constructed according to the invention.
Figure 1A:
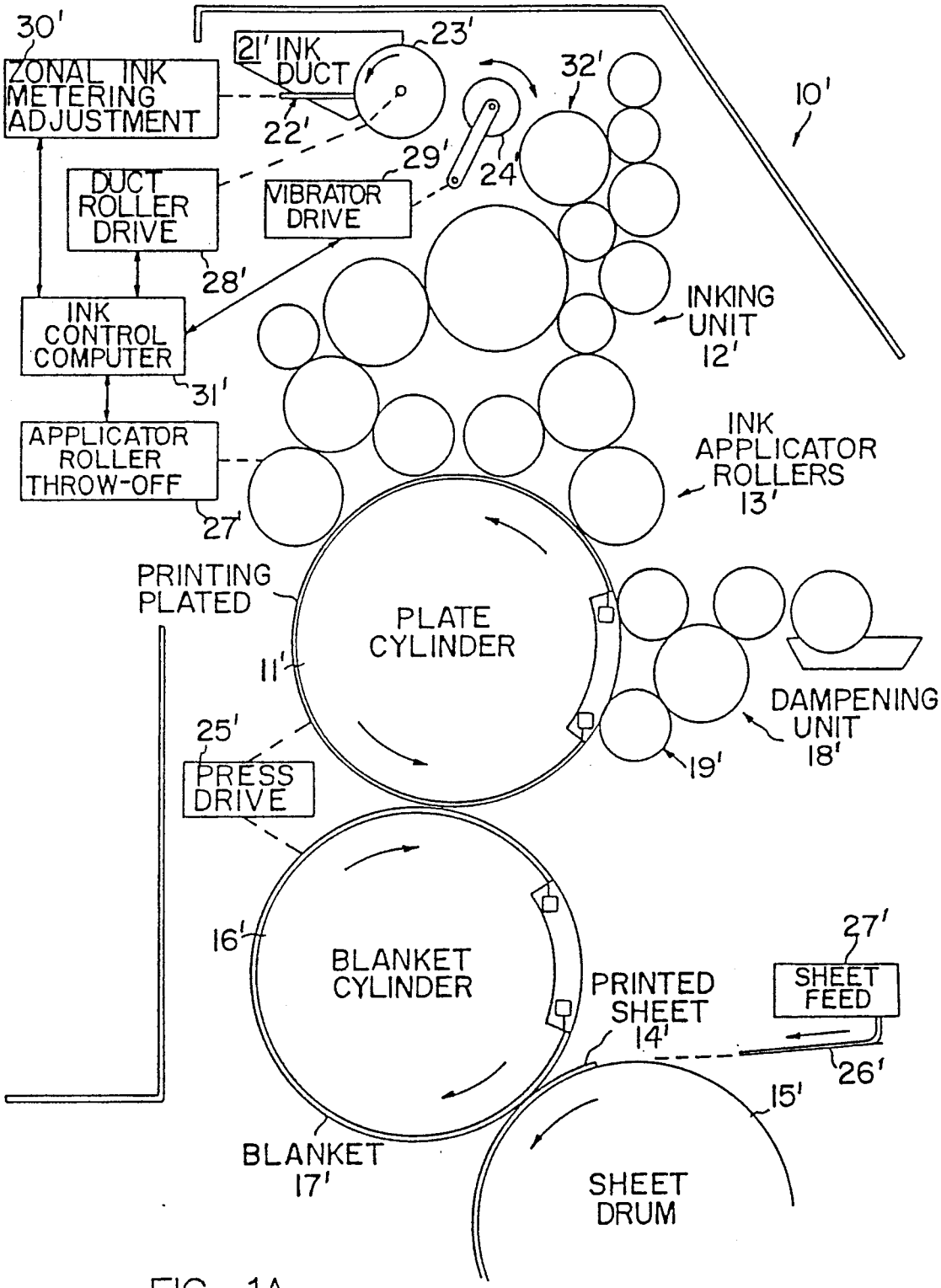
FIG. 1A is a general schematic representation of one printing stand of a rotary offset printing press, in cooperation with which the present invention provides an improved apparatus for the folding of printed sheets conveyed therein.

Referring first to FIG. 1A, a rotary print stand 10', well known in the art, generally includes: a plate cylinder 11' having mounted thereon a printing plate D'; an inking unit 12' which includes ink applicator rollers 13' for applying to printing plate D' an ink profile of a single color printing ink (for example, black, cyan, magenta or yellow); a unit 18' having wetting applicator rollers 19' for transferring a wetting agent to printing plate D'; a blanket cylinder 16' carrying a rubber blanket 17' for receiving an ink impression from printing plate D'; and a sheet drum 15' for carrying a printed sheet 14' onto which the ink impression carried by blanket 17' is transferred.

It is particularly important that the ink be applied to printing plate D' in a precisely defined and controllable manner. That is, those areas of printing plate D' having a high density of printed content will require a greater ink flow during the printing process than those areas having a lower density of printed content. To this end, the printing stand 10' is typically provided with a means for zonally varying the ink application profile across the width of the printing stand 10'. For example, as shown in FIG. 1, printing stand 10' may be provided with an ink duct 21' which extends across its width. The zonal adjustment of the ink application profile is provided by a plurality of ink metering ducts 22' which may be controlled or adjusted by a zonal ink metering adjustment mechanism 30' under the control of a computer 31'.

A duct roller 23' is typically mounted adjacent to ink duct 21'. An ink duct of this type is further described in U.S. Pat. No. 3,978,788, issued Sep. 7, 1976.

Typically, the ink application profile which is set up on duct roller 23' is transferred into the inking unit 12' by means of a vibrator roller 24' which oscillates to successively pick up strips of ink from duct roller 23' and transfer them into inking unit 12', as for example, by contacting one of the rollers 32' thereof. The operation of such a vibrator roller 24' is more fully described in U.S. Pat. No. 3,908,545, issued Sep. 30, 1975.

Typically, the printing stand 10' will also include auxiliary mechanisms such as, for example, a duct roller drive 28', a vibrator roller drive 29', an applicator roller throw-off 27' for lifting the ink applicator rollers 13' off of the printing plate D', a press drive 25' and a sheet feed 27' for supplying the sheets to be printed 26' to sheet drive drum 15'.

Referring now most particularly to FIG. 1, the product to be folded (in the preferred embodiment, a sheet of paper for receiving printing thereon in a rotary printing press) is transported, in the direction shown and in a manner well known in the prior art, by web guide tapes 1 across a folding table 2 to stops 3 and, immediately after the gentle aligning contact of the stops 3, is pushed by the folding blade 4 between folding rollers 5, which then transport the folded product away in a downward direction. In this connection, the instant of impact of the folding blade 4, and thus the instant of folding, can be set by adjusting the phase position of the folding blade 4 with respect to the product to be folded (i.e., the printed sheets).

Figure 2:
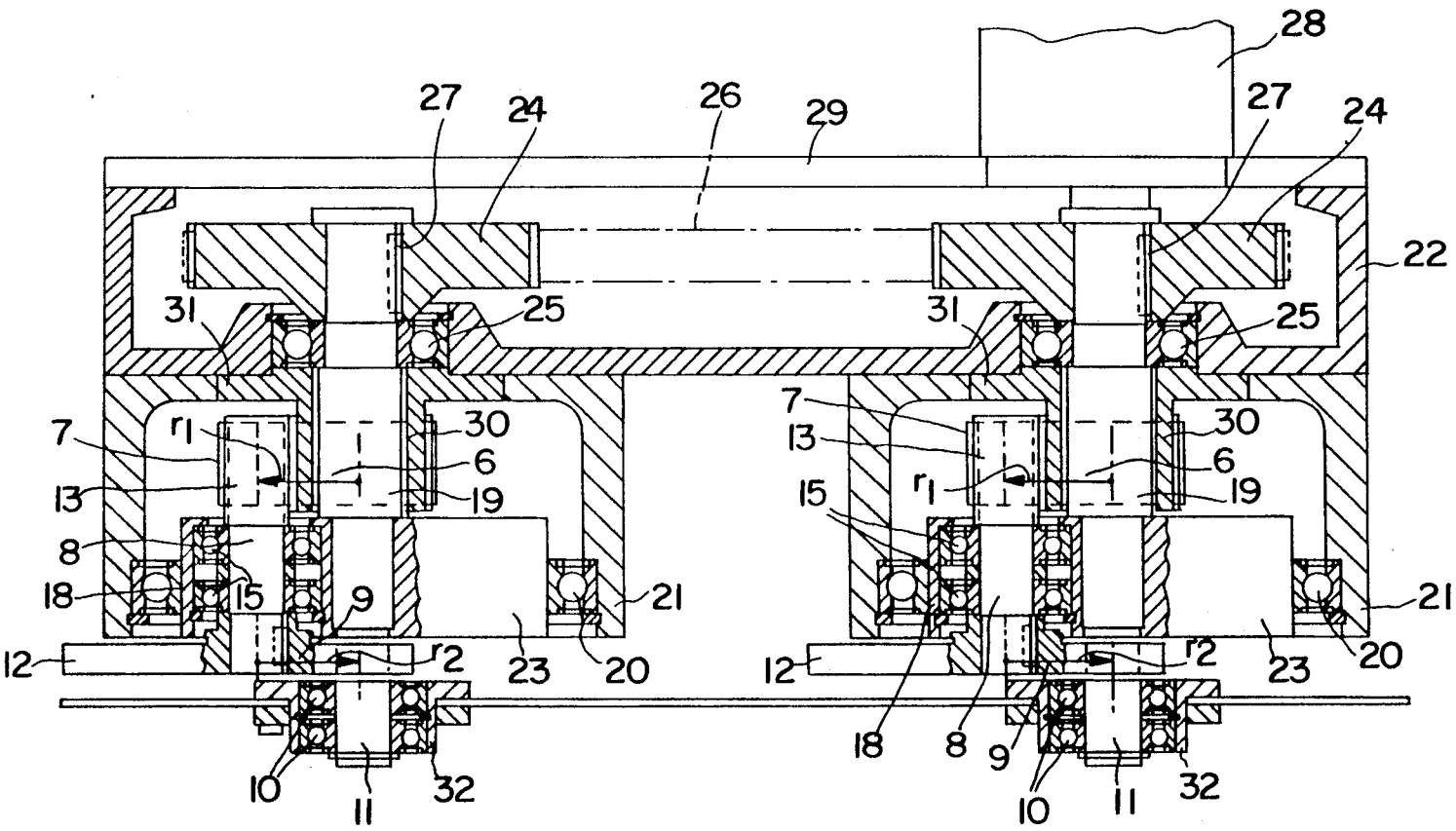
FIG. 2 is front elevational view of a longitudinal section through the folding blade control of the folding apparatus.

The up-and-down motion of the folding blade 4 is produced by two drive cranks 6, on whose radius $r_1$ of pivot pins 8 is held an additional crank 9 of radius $r_2$ (FIG. 2). In this connection, the folding blade 4 is held by ball bearings 10 on a crank pin 11 of the additional crank 9. In order to balance the masses, the additional crank 9 bears a counterweight 12.

Referring now most particularly to FIG. 2, provided on a pivot pin 8 of the additional crank 9 is a gearwheel 13, the gearwheel 13 being driven by a toothed belt 7. The pivot pin 8 is held by ball bearings 15 in a rotating body 18 with radius $r_1$ of the drive crank 6. The rotating body 18 is held by a ball bearing arrangement 20 in a bearing holder 21 centrally with respect to the drive pin 19 of the drive crank 6. The bearing holder 21 is, in turn, mounted within the carrier 22. In order to balance the masses, the rotating body 18 is also provided with a counterweight 23.

In the embodiment shown in FIG. 2, the drive pin 19 is held likewise in the carrier 22 by a second ball bearing arrangement 25. The drive pins 19 are driven by gearwheels 24 attached thereto, which are interconnected to one another through the intermediary of a toothed belt 26. A belt tensioner may optionally be provided for maintaining a tension on the toothed belt 26. The gearwheels 24 are mounted on the drive pins 19 through the provision of feather keys 27. Provided on one of the two drive pins 19 is a gear drive 28, the gear drive 28 being mounted on a cover 29 of the carrier 22.

When the two drive pins 19, with the rotating bodies 18 attached thereto, are driven, the pivot pin 8 of radius $r_1$ rotates about the drive pin 19. Provided centrally with respect to the drive pin 19 is a gearwheel 30, said gearwheel 30 being connected to the gearwheel 13 through the intermediary of the toothed belt 7. The gearwheel 30 has preferably twice the diameter of the gearwheel 13. The gearwheel 30 is attached to the carrier 22 by a flange 31. While the rotating bodies 18, with the pivot pins 8 held therein, execute a rotary motion, the gearwheels 13 are rotated in the opposite direction through the intermediary of the toothed belts 7.

Referring back now to FIG. 1, the drive crank 6 of radius $r_1$ moves in a clockwise direction (as shown by an arrow) and the additional crank of radius $r_2$ moves in an anticlockwise direction. In the position shown by the solid line, the folding blade 4, which is mounted on a bearing holder 32, is at a slight distance above the folding table 2. If one follows the rotational motion of the pivot pin 8, then the next position of the crank pin 11 (shown by the dash-dotted line) is just before the bottom dead center, i.e., that is, the instant directly prior to the gripping of the printed product by the folding rollers 5. Also represented by dash-dotted lines in FIG. 1 are the top-dead-center positions of the drive crank and the additional crank.

With the described design of the folding device, the total stroke of the folding blade 4 is thus precisely equivalent to twice the length of the two radii $r_1$ and $r_2$. With these transmission ratios, the crank pin 11 of the additional crank 9 performs a precisely rectilinearly vertical and central motion with respect to the drive pin 19. Consequently, the folding blade 4 also executes a rectilinear, vertical reciprocating motion. This is the case when the crank radius $r_1$ of the drive crank is identical to the crank radius $r_2$ of the additional crank, and when there is a transmission ratio of 2:1 between the gearwheel 30 and the gearwheel 13. In the preferred embodiment described, the drive crank 6 executes one revolution per folding cycle.

In other words, a pair of gearwheels (or drive wheels) 24 are rotationally interconnected to one another through the provision of a toothed belt 26. [Such toothed belts are well known to those of ordinary skill in the mechanical arts and are described in various documents identified below.]One of the gearwheels 24 is rotationally driven by a gear drive 28, and the two gearwheels 24 are thus caused to rotate synchronously. Optionally, a belt tensioner mechanism (also well known to the average artisan in the mechanical field, and described in documents identified below) may be provided to prevent the occurrence of any undesirable "play" between the gearwheels 24.

Through a transmission mechanism substantially enclosed within a bearing holder (or housing) 21, the driven synchronous rotation of the gearwheels 24 causes (as described hereafter) a simultaneous vertical reciprocating motion of a pair of crank pins 11, which are both rotationally connected to a folding blade 4, the rotational connections to the folding blade 4 being spaced from one another along the direction of travel of the printed sheets. In some instances, it may be desirable to adjust the vertical positioning (or phase) of the folding blade 4 with respect to the positioning of the printed sheets along their direction of conveyance. In a simple case, such phase adjustment can be easily achieved by merely altering the rotational positioning of the gearwheels 24 with respect to the positioning of the printed sheets. For example, provision of a rotationally adjustable gear drive 28 (such mechanisms being well known in the mechanical arts) allows such phase adjustment to be accomplished in a ready manner.

The gearwheels 24 are fixedly mounted on a pair of drive pins (or axles) 19, which extend through a carrier 22 and the bearing holder 21, and which are rotationally mounted in bearings 25 (preferably of ball bearing construction) provided in the carrier 22. A first pair of crank members 6 are fixedly attached to the drive pins 19 and extend radially outward therefrom. The radially outward ends of the crank members 6 are provided with rotational ball bearing mountings 15 set therein, and a second pin (or axle) 8 extends through each of the ball bearing mountings 15, the axes of the two pins 19 and 8 being substantially parallel to one another.

An interior portion of each of the second pins 8 is provided with a preferably toothed gear surface 13 about its circumference. Additionally, adjacent each of the gear surfaces 13, there is provided a second gear surface 30. Each second gear surface 30 encircles its respective first drive pin 19 and is preferably fixedly attached to the interior surface of the bearing holder (or housing) 21. One each of a pair of toothed belts 7 rotationally interconnects each pair of associated gear surfaces 30 and 13, and the gear surfaces 30 and 13 preferably have diameter ratios of substantially 2:1.

The outwardly disposed ends of each of the second pins 8 are provided with a second crank (or crank member) 9 fixedly attached thereto and extending radially outward therefrom. However, each of the second cranks 9 is also oriented to extend generally radially inward toward the rotational axis of the respective associated first pin (or axle) 19. Finally, each second crank 9 is provided with another rotational bearing 10 (preferably a ball bearing arrangement) at a point coinciding with the rotational axis of each respective associated first pin 19, wherein the associated crank pins 11 are rotationally mounted.

In operation, the pair of first bearing pins (or axels) 19 are rotated within the rotational bearings 25 under the rotational drive provided by their connection to the gearwheels 24. This causes the rotational ball bearing mountings 15 provided on the radially outward ends of the first pair of crank members 6 to execute a clockwise circular (or planetary) motion, of radius $r_1$, about the central axis of the first bearing pins 19. Additionally, this planetary motion, and the toothed belts 7 which engage each pair of associated gear surfaces 30 and 13, causes the second pins (or axels) 8 to undergo a counterclockwise rotational motion within the rotational ball bearing mountings 15. The construction described results in the crank pins 11 executing an exact vertical reciprocation with a stroke length equal to $r_1+r_2$.

Toothed belts for the transmission of power are well known in the art and are described for example, in U.S. Pat. No. 4,850,943, issued on Jul. 25, 1989 and entitled "Toothed Belt"; U.S. Pat. No. 4,838,843, issued on Jun. 13, 1989 and entitled "Toothed Belt"; U.S. Pat. No. 4,690,664, issued on Sep. 1, 1987 and entitled "Toothed Belt"; and U.S. Pat. No. 4,586,915, issued on May 6, 1986 and entitled "Power Transmission System and Toothed Belt Therefor".

Tensioners for toothed belt transmission systems are also well known in the art and are disclosed, for example, in U.S. Pat. No. 4,909,777, issued on Mar. 20, 1990 and entitled "Tensioner for Toothed Belts" and in U.S. Pat. No. 4,708,696, issued on Nov. 24, 1987 and entitled "Tensioner for Toothed Drive Belts".

Finally, toothed pulleys or gearwheels for use in conjunction with toothed belts are disclosed in U.S. Pat. No. 4,634,410, issued on Jan. 6, 1987 and entitled "Toothed Pulley for Transmission with a Toothed Belt" and in U.S. Pat. No. 4,605,388, issued on Aug. 12, 1986 and entitled "Sheet Metal Pulley for Toothed Belts and Manufacturing Process Therefor".

One aspect of the invention resides broadly in a folding device for web-fed rotary printing presses for the making of a longitudinal fold in the conveying direction of the printed copies, said longitudinal fold being produced after the cylinder cross-fold, said folding device comprising a folding blade disposed parallel to the conveying direction, said folding blade being suspended on two parallel drive cranks, rotating at identical speed, with axes of the crank pins extending transversely to the conveying direction, and with said folding blade being moved up and down by said drive cranks and, when in its bottom position, pushing the printed copies between two driven folding rollers, with the folding blade being suspended on the drive crank through the intermediary of an additional crank, with the crank radius $r_1$ of the drive crank being identical to the crank radius $r_2$ of the additional crank and with the additional crank being coaxially held by its pivot pin on the crank pin of the drive crank, characterized in that the additional crank 9 is driven through the intermediary of a toothed belt 7 at identical rotational speed to the drive crank 6 but in the opposite direction of rotation to the latter, such that the crank pin 11 of the additional crank 9 executes a rectilinearly vertical reciprocating motion.

Another aspect of the invention resides broadly in a folding device characterized in that the pivot pin 8 of the additional crank 9 bears a gearwheel 13, said gearwheel 13 being driven, through the intermediary of a toothed belt 7, by a gearwheel 30, said gearwheel 30 being fixed centrally with respect to the drive pin 19 of the drive crank 6.

Yet another aspect of the invention resides broadly in a folding device characterized in that there is a diameter ratio of 1:2 between the gearwheel 13 on the pivot pin 8 of the additional crank 9 and the gearwheel 30 held centrally with respect to the drive pin 19 of the drive crank 6, and in that the drive pin 19 of the drive crank 6 executes one revolution per folding cycle.

A further aspect of the invention resides broadly in a folding device characterized in that a gearwheel 24 is mounted on each of the two drive pins 19 of the drive cranks 6, said gearwheels 24 being connected through the intermediary of a toothed belt 26 and being adjustable in their phase positions with respect to the copy to be folded.

A yet further aspect of the invention resides broadly in a folding device characterized in that the drive crank 6 and the additional crank 9 bear counterweights 12, 23 opposite their crank pins 8, 11.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A rotary printing press having an apparatus for folding a sheet of paper, the sheet of paper being conveyed in a direction of travel within the rotary printing press, the printing press including a web moving in the direction of travel for conveying the sheet of paper, said apparatus comprising:

a folding blade; and transmission means for moving said folding blade in a periodic reciprocating motion at a right angle to the direction of travel;

said transmission means comprising:

a pair of drive wheels spaced from one another along the direction of travel, each of said pair of drive wheels having a pivotally mounted first axle attached thereto;

means for rotationally powering one of said pair of drive wheels;

a flexible belt engaging at least a portion of the peripheral surfaces of both of said pair of drive wheels for transmitting rotational power therebetween;

a first pair of crank members, each of said first pair of crank members being attached to one of said first axle members, each of said first pair of crank members extending radially outward from the rotational axis of said attached first axle member, and each of said first pair of crank members being provided with a rotational bearing, the distance between the center of said rotational bearing provided on each of said first pair of crank members and said rotational axis of said attached first axle being $r_1$;

a second pair of axles, each of said second pair of axles being rotationally mounted in one of said rotational bearings:

a first gear surface encircling each of said pair of first axles;

a second gear surface provided on each of said second pair of axles and positioned adjacent one of said first gear surfaces;

a pair of flexible belts rotationally interconnecting each of said first gear surfaces with each of said respective adjacent second gear surfaces;

a second pair of crank members, each of said second pair of crank members being attached to one of said second pair of axles, each of said second pair of crank members extending radially outward from the rotational axis of said attached second axle and radially inward towards the rotational axis of an associated first axle, and each of said second pair of crank members being pivotally attached to a portion of said folding blade, the distance between said point of pivotal attachment of said folding blade to each of said second pair of crank members and the rotational axis of said attached second axle being $r_2$.

2. The rotary printing press according to claim 1, wherein each of said first gear surfaces encircling each of said pair of first axles is fixed in a substantially stationary fashion.

3. The rotary printing press according to claim 2, said apparatus further comprising a housing, said housing substantially enclosing at least said pair of first axles and said first pair of crank members, said housing being provided with a pair of additional rotational bearings, one each of said pair of first axles being rotationally mounted in a respective one of said pair of additional rotational bearings.

4. The rotary printing press according to claim 3, wherein each of said first gear surfaces is substantially fixedly attached to said housing.

5. Apparatus for folding a sheet of paper, the sheet of paper being conveyed in a direction of travel within a rotary printing press, the printing press including a web moving in the direction of travel for conveying the sheet of paper, said apparatus comprising:

a folding blade; and transmission means for moving said folding blade in a periodic reciprocating motion at a right angle to the direction of travel;

said transmission means comprising:

a pair of drive wheels spaced from one another along the direction of travel, each of said pair of drive wheels having a pivotally mounted first axle attached thereto;

means for rotationally powering one of said pair of drive wheels;

a flexible belt engaging at least a portion of the peripheral surfaces of both of said pair of drive wheels for transmitting rotational power therebetween;

a first pair of crank members, each of said first pair of crank members being attached to one of said first axle members, each of said first pair of crank members extending radially outward from the rotational axis of said attached first axle member, and each of said first pair of crank members being provided with a rotational bearing, the distance between the center of said rotational bearing provided on each of said first pair of crank members and said rotational axis of said attached first axle being $r_1$;

a second pair of axles, each of said second pair of axles being rotationally mounted in one of said rotational bearings;

a first gear surface encircling each of said pair of first axles;

a second gear surface provided on each of said second pair of axles and positioned adjacent one of said first gear surfaces;

a pair of flexible belts rotationally interconnecting each of said first gear surfaces with each of said respective adjacent second gear surfaces;

a second pair of crank members, each of said second pair of crank members being attached to one of said second pair of axles, each of said second pair of crank members extending radially outward from the rotational axis of said attached second axle and radially inward towards the rotational axis of an associated first axle, and each of said second pair of crank members being pivotally attached to a portion of said folding blade, the distance between said point of pivotal attachment of said folding blade to each of said second pair of crank members and the rotational axis of said attached second axle being $r_2$.

6. The apparatus according to claim 5, wherein each of said first gear surfaces encircling each of said pair of first axles is fixed in a substantially stationary fashion.

7. The apparatus according to claim 6, said apparatus further comprising a housing, said housing substantially enclosing at least said pair of first axles and said first pair of crank members, said housing being provided with a pair of additional rotational bearings, one each of said pair of first axles being rotationally mounted in a respective one of said pair of additional rotational bearings.

8. The apparatus according to claim 7, wherein each of said first gear surfaces is substantially fixedly attached to said housing.

9. The apparatus according to claim 5, wherein the ratios between the diameters of each of said first gear surfaces and each of said associated second gear surfaces is substantially 2:1.

10. The apparatus according to claim 9, further comprising drive means for causing each of said first axles to undergo substantially one revolution per folding cycle.

11. The apparatus according to claim 10, said apparatus further comprising means for adjusting the rotational phases of said pair of drive means.

12. The apparatus according to claim 8, said apparatus further comprising a first pair of counterweight members, one of said first pair of counterweight members being attached to each of said first axles at a position substantially radially diametrically opposed to said first crank member attached thereto.

13. The apparatus according to claim 9, said apparatus further comprising a second pair of counterweight members, one of said second pair of counterweight members being attached to each of said second axles at a position substantially radially diametrically opposed to said second crank member attached thereto.

14. The apparatus according to claim 8, wherein the ratios between the diameters of each of said first gear surfaces and each of said associated second gear surfaces is substantially 2:1.

15. The apparatus according to claim 14, further comprising drive means for causing each of said first axles to undergo substantially one revolution per folding cycle.

16. The apparatus according to claim 15, said apparatus further comprising means for adjusting the rotational phases of said pair of drive means.

17. The apparatus according to claim 16, said apparatus further comprising a first pair of counterweight members, one of said first pair of counterweight members being attached to each of said first axles at a position substantially radially diametrically opposed to said first crank member attached thereto.

18. The apparatus according to claim 17, said apparatus further comprising a second pair of counterweight members, one of said second pair of counterweight members being attached to each of said second axles at a position substantially radially diametrically opposed to said second crank member attached thereto.

19. The apparatus according to claim 9, wherein said distance $r_1$ and said distance $r_2$ are substantially identical.

20. The apparatus according to claim 14, wherein said distance $r_1$ and said distance $r_2$ are substantially identical.

* * * * *